US006234253B1

(12) United States Patent
Dallas

(10) Patent No.: US 6,234,253 B1
(45) Date of Patent: May 22, 2001

(54) METHOD AND APPARATUS FOR WELL WORKOVER OR SERVICING

(76) Inventor: L. Murray Dallas, 801 New England Ct., Allen, TX (US) 75002

( * ) Notice: Subject to any disclaimer, the term of this patent is extended or adjusted under 35 U.S.C. 154(b) by 0 days.

(21) Appl. No.: 09/201,619

(22) Filed: Nov. 30, 1998

(51) Int. Cl.[7] ..... E21B 19/16

(52) U.S. Cl. ..... 166/377; 166/77.4; 166/85.4; 166/383; 254/30

(58) Field of Search ..... 166/377, 379, 166/383, 77.4, 85.1, 85.3, 85.4; 254/29 R, 30

(56) References Cited

U.S. PATENT DOCUMENTS

| | | | | |
|---|---|---|---|---|
| 2,661,063 | | 12/1953 | Owens . | |
| 4,290,495 | * | 9/1981 | Elliston | 175/85 |
| 4,476,936 | * | 10/1984 | Boyadjieff et al. | 166/383 |
| 4,756,366 | | 7/1988 | Maroney et al. . | |
| 5,020,590 | * | 6/1991 | McLeod | 166/77 |
| 5,253,845 | | 10/1993 | Wilbert . | |
| 5,704,427 | | 1/1998 | Buck et al. . | |
| 5,816,565 | | 10/1998 | McGuffin . | |
| 5,890,534 | * | 4/1999 | Burge et al. | 166/77.3 |

* cited by examiner

*Primary Examiner*—David Bagnell
*Assistant Examiner*—Zakiya Walker
(74) *Attorney, Agent, or Firm*—Nelson Mullins Riley & Scarborough, LLP

(57) ABSTRACT

The present invention relates to a method and apparatus for the servicing or workover of a hydrocarbon well. The apparatus includes a pair of hydraulic cylinders pivotally mounted to a pair of base beams connected to each other. The cylinders are moveable from a horizontal position for transportation to a vertical position for operation in which position the two cylinders flank a wellhead and are adapted to lift the wellhead and attached production tubing using a workover beam and a lifting sub. The wellhead and production tubing can be rotated as or after they are elevated. A motor may be mounted to the workover beam to rotate the wellhead and the tubing. A calibrated pressure gauge may be used to indicate the weight being lifted. The apparatus can be wheel mounted and towed behind a crane truck. The advantage is a safe, economical and timesaving apparatus for performing jobs that previously required the setup and operation of a workover rig.

16 Claims, 4 Drawing Sheets

METHOD AND APPARATUS FOR WELL WORKOVER OR SERVICING

TECHNICAL FIELD

The present invention relates to the servicing or workover of hydrocarbon wells and, in particular, to a method and apparatus for the servicing or workover of a hydrocarbon well when tubing does not need to be run into or removed from the well.

BACKGROUND OF THE INVENTION

Hydrocarbon production wells which are drilled in the earth to produce oil or gas must be reworked or serviced from time to time. Wells may require service for a number of reasons. For example, worn or faulty valves may require replacement, seals may need to be replaced or renewed, or it may be necessary or desirable to insert a new flange or remove a flange from the wellhead, etc. Well workover generally entails well treatments to stimulate hydrocarbon production. Such treatments may include high pressure fracturing and/or acidizing. During well stimulation it is common knowledge that it is preferable to introduce stimulation fluids into the well at the highest possible transfer rate. Consequently, the wellhead is now frequently removed and stimulation fluids are pumped through the blowout preventers and into the casing. In order to protect the blowout preventers, blowout preventer protectors have been invented, as described in Applicant's U.S. Pat. No. 5,819,851 which issued on Oct. 13, 1998. Generally, a workover rig is brought in and setup to remove the wellhead components when well workover is required. Such rigs comprise a derrick or mast which supports pulleys or block and tackle arrangements operable to pull the wellhead from the well and may also be used to pull the production tubing string from the well bore or run a production tubing string or other tools into the well.

The rig is used to remove and replace the wellhead, unseat and reseat the packers and/or anchors in the well, etc. Although workover rigs are functional and adapted to perform any job associated with manipulating well components during a well workover, they are large assemblies of equipment that are expensive to move and setup. Besides, they require a crew of four, so they are expensive to operate.

A workover rig may also be brought in for servicing a well to install blowout preventers (BOPs), repair or replace valves or seals, etc. In each of these servicing operations the production tubing is not removed from or run into the well. Nonetheless, the production tubing may have to be lifted with the wellhead.

Efforts have been made to develop various types of lifting apparatus for use in well workovers and well servicing operations. In particular, a portable or compact apparatus has been invented for replacing a large conventional well rig for lifting a wellhead and production tubing string in certain well servicing or workover applications. U.S. Pat. No. 4,756,366 which issued to Maroney et al. on Jul. 12, 1988 and is entitled "WELL SERVICING METHODS USING A HYDRAULIC ACTUATED WORKOVER MAST", discloses a portable workover rig for lowering and raising objects such as pipe into and out of a borehole. The workover rig is mounted to a heavy vehicle and includes a mast which can be raised from a horizontal to a vertical position, a hydraulic system and drum cable system. Nevertheless, the portable workover rig disclosed in this patent is expensive to construct and operate because a dedicate vehicle, a dedicated hydraulic system and a complicated mechanical structure are involved.

A tool useful in pulling casing from a dead well is illustrated in U.S. Pat. No. 2,661,063, which issued to Owens on Dec. 1, 1953 and is entitled "METHOD AND MEANS OF PULLING PIPE FROM A WELL". Owens discloses the use of a pair of hydraulic jacks to loosen a pipe that gets stuck while being pulled from a dead well by a rig. The jacks exert an upward force through two arms affixed to a collar attached by shearable pins to the pipe being pulled by the rig. The pins shear unless the pipe dislodges from the stuck position. The shearing of the pins causes a downward jar or jerk on the pipe that tends to loosen the pipe. After the pipe is loosened, it is pulled from the well using the rig until it is removed, or it gets stuck again. It is apparent that the jacks used in this application are auxiliary and only used in conjunction with a rig. The jacks are not designed to lift a wellhead for well servicing or workover. Nor is the pipe being lifted by the jacks rotatable relative to the collar due to the shearable pin connection between the two. Therefore, this apparatus is not adapted for well servicing or workover.

There therefore exists a need for a safe, economical apparatus for well servicing or workover which permits a servicing or workover operation to be rapidly and efficiently accomplished when tubing does not need to be run into or removed from the well.

SUMMARY OF THE INVENTION

An object of the invention is to provide an apparatus for lifting a wellhead, a production tubing string, or a wellhead with an attached production tubing string for well servicing or workover.

Another object of the invention is to provide an apparatus and method for well servicing or workover in a safe, economical and fast manner when the production tubing does not need to be run into or removed from the well.

A further object of the invention is to provide a portable apparatus for lifting a wellhead, a production tubing string or a wellhead with an attached tubing production string.

In accordance with one aspect of the invention, there is provided an apparatus for well servicing or workover comprising:

- a pair of base assemblies connected to each other in a spaced apart relationship adapted to flank a wellhead;
- a pair of lifting devices respectively mounted to the base assemblies for lifting the wellhead, the wellhead with an attached production tubing string, or a production tubing string;
- a workover beam supported at opposite ends by the lifting devices; and
- a lifting sub connected to the workover beam and adapted for detachable connection to the wellhead or the production tubing string so that the wellhead is rotatable when disconnected from the well and the lifting devices are operated to raise the workover beam.

The lifting devices are preferably a pair of hydraulic cylinders. Each of the base assemblies preferably comprise a base beam, a plate extending longitudinally of and upwardly from the base beam, and a locking device associated with the plate for releasably retaining the lifting devices in a vertical position.

Each of the cylinders is preferably mounted to the plate by a pivotal axis perpendicular to the plate so that the lifting devices are pivotally moveable to a horizontal position for transportation, in which position the lifting devices are parallel to the base beam. The base beams are preferably parallel to each other and interconnected by a plurality of cross-members. The cross-members are preferably permanently affixed to one end of the base beams and detachably connected to the other end of the base beams to permit the apparatus to be positioned so that the base beams flank the wellhead.

The lifting sub is preferably rotatable relative to the workover beam so that the wellhead and/or the production tubing string may be rotated while it is attached to the lifting sub. The apparatus may further comprise a motor mounted to the workover beam and associated with the lifting sub to permit the wellhead or a production tubing connected to the lifting sub to be rotated under mechanical force exerted by the motor.

In accordance with another aspect of the invention, a method of well servicing or workover comprises:

a) placing on a well site an apparatus which includes lifting devices that are respectively supported by a pair of interconnected base assemblies so that the wellhead is flanked by the lifting devices;

b) connecting the wellhead to a lifting sub secured to a workover beam supported on opposite ends by the respective lifting devices;

c) disconnecting the wellhead at a point required for the well servicing or workover operations;

d) raising the workover beam by operating the lifting devices;

e) performing the well servicing or workover operations;

f) lowering the workover beam by operating the lifting devices after the well servicing or workover operation is completed;

g) reconnecting the wellhead and disconnecting the lifting sub from the wellhead; and h) removing the apparatus from the well site.

Preferably, step b) is completed by removing a wellhead cap and connecting the lifting sub to a top of the wellhead.

The advantageous structure of the apparatus and the method according to the invention provide a simple, safe, fast and economic manner of performing a well service or workover operation, particularly, in the cases in which the production tubing does not need to be run into or removed from the well. The use of hydraulic cylinders as lifting devices also provides a convenient method of calculating the weight of the wellhead, and/or any production tubing that has been lifted. The weight can be calculated using a reading from a pressure gauge that is connected to the service line for supplying hydraulic fluid to the cylinders.

The structure of the apparatus is also adapted to facilitate transportation. The apparatus may be constructed as a skid or may be rubber wheel mounted and provided with a hitch to permit towing behind a crane truck or the like. If rubber wheel mounted, the wheels are preferably pivotally mounted to the base beams and rotatable from a transport position to a working position. Hydraulic cylinders may be used to shift the wheels from the transport to the working position.

Other features and advantages of the apparatus will be clearly understood from the detailed description of the preferred embodiment which follows.

BRIEF DESCRIPTION OF THE DRAWINGS

The invention will now be described in more detail by way of example only and with reference to the accompanying drawings, in which.

DETAILED DESCRIPTION OF THE PREFERRED EMBODIMENT

Figure 1:
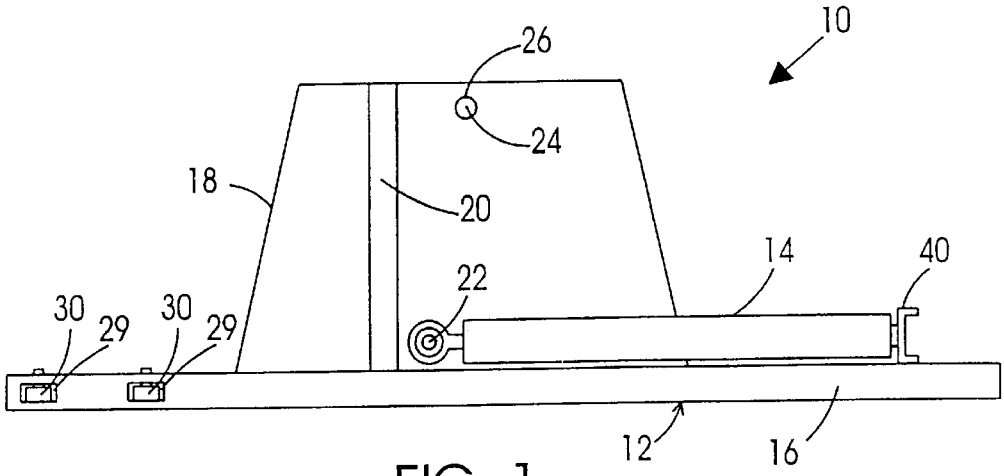
FIG. 1 is a schematic side elevational view of a preferred embodiment of an apparatus in accordance with the invention, illustrating the apparatus with a pair of lifting devices in a horizontal position for transportation.
Figure 2:
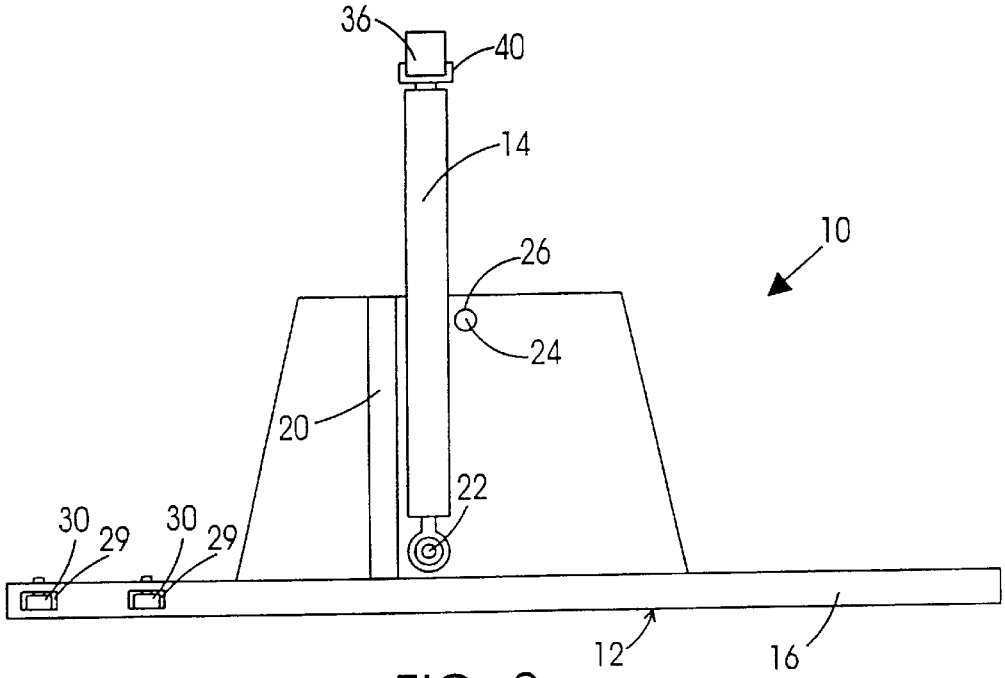
FIG. 2 illustrates the embodiment shown in FIG. 1 in the same view with the lifting devices in a vertical working position.

As shown in FIGS. 1 and 2, the apparatus of the present invention for well servicing and workover is generally designated by reference numeral 10. The apparatus 10 includes a pair of spaced apart base assemblies 12 and lifting devices 14. The lifting device 14 are preferably hydraulic cylinders, but may be ball jacks (not shown) or any other appropriate and robust lifting device. Each base assembly preferably includes an elongated steel base beam 16 which has a rectangular cross-section. A trapezoidal plate 18 extends upwardly from a center portion of the base beam 16 and is affixed to an inner side of the base beam 16, as more clearly illustrated in FIGS. 3 and 4. A vertical ram support 20 which extends from a top of the base beam 16 to a top edge of the trapezoidal plate 18 supports the lifting device 14 in a vertical working position. The entire base assembly 12 is preferably a welded steel structure.

The lifting device 14 is mounted to the outside of the plate 18 by a pivot pin 22 that is located above the base beam 16 adjacent the ram support 20, so that the lifting device 14 is pivotally moveable from a horizontal position for transport, as shown in FIG. 1, to a vertical position for working, as shown in FIG. 2. A bore 24, or the like, is provided near a top of the plate 18 for detachably receiving a lock pin 26 that is more clearly illustrated in FIG. 4. The lifting device 14 is securely supported in the vertical position between the ram support 20 and the lock pin 26.

Figure 3:
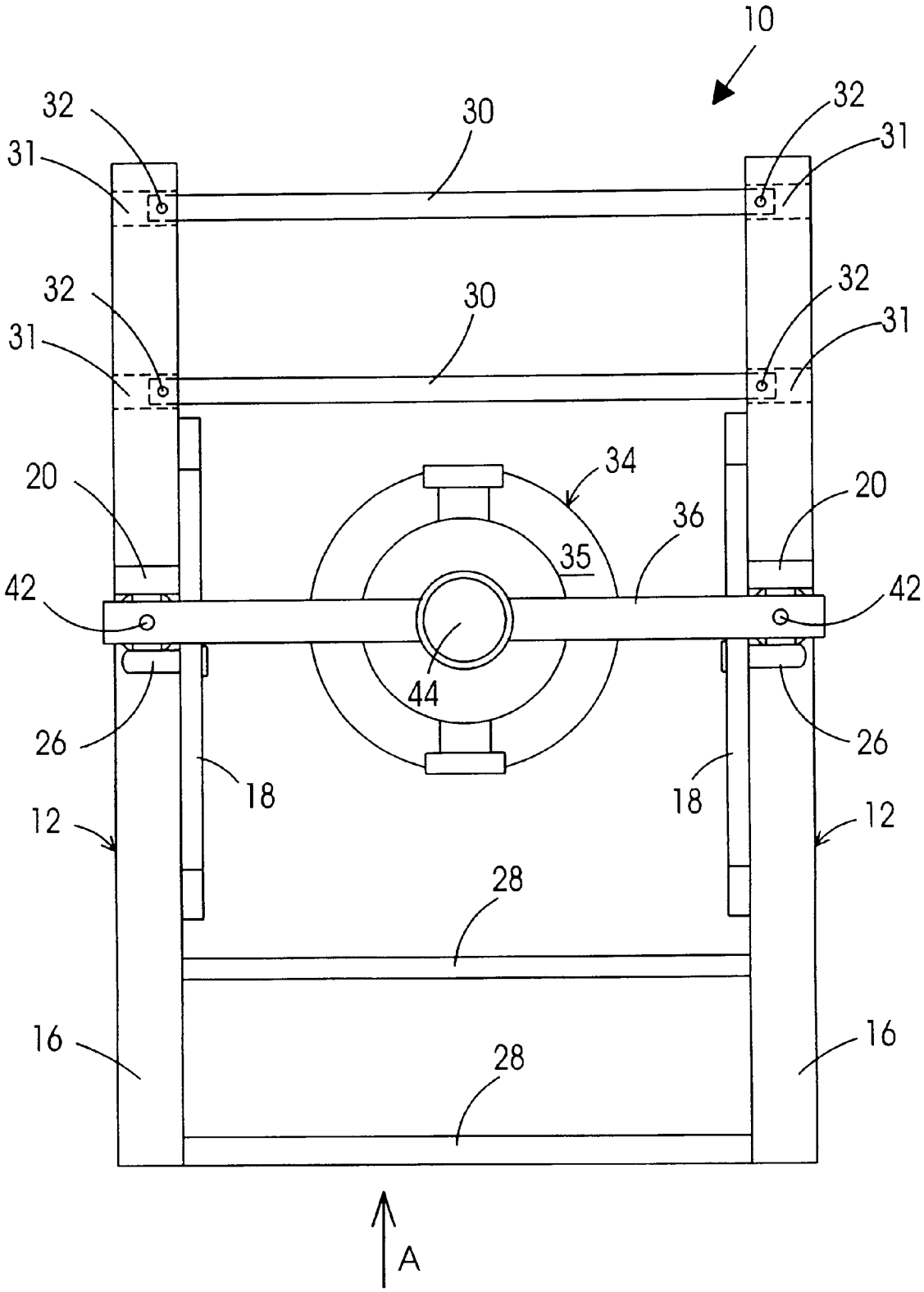
FIG. 3 is a schematic plan view of the embodiment shown in FIG. 1, in a working position over a wellhead.
Figure 4:
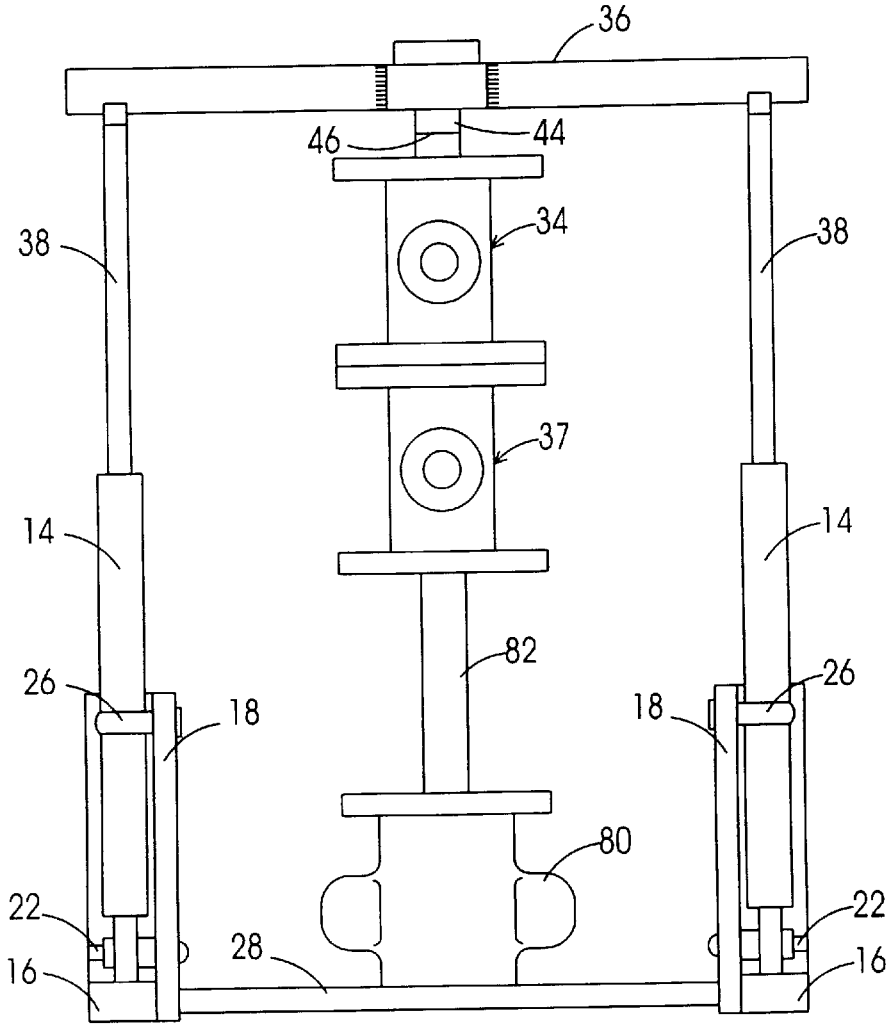
FIG. 4 is a schematic elevational view from a point indicated by arrow A of FIG. 3, illustrating a step in the servicing or workover of a hydrocarbon well using the apparatus shown in FIGS. 2 and 3.

As illustrated in FIGS. 3 and 4, the pair of base assemblies 12 are interconnected at one end by permanent cross-members 28 which are preferably welded to the base beams 16 and at the other end by detachable cross-members 30 which are detachably connected to the base beams 16 using connector pins 32, or the like. The detachable cross-members are preferably received in pockets 31 formed in the base beams 16 to ensure maximum rigidity of the apparatus 10. The detachable cross-members 30 are removed when the apparatus 10 is to be positioned so that the wellhead 34 is flanked by the lifting devices 14, as shown in FIG. 3. The two pivot pins 22 should be lined up with a center of the wellhead 34 when the apparatus 10 is in the working position. The detachable cross-members 30 are re-connected to the base beams 16 after the apparatus is manoeuvred into the working position. A workover beam 36 is supported at each end by a cradle 40 that is fixed to an end of a ram 38 of the lifting device 14. The workover beam 36 is preferably attached to the cradle 40 by lock pins 42 (FIG. 3) that are releasably received in bores in the workover beam 36 (the bores are not shown). A lifting sub 44 is releasably received in an aperture (not shown) in a middle of the workover beam 36. The lifting sub 44 preferably incorporates a swivel 46 to permit the wellhead 34 and attached production tubing to be rotated while attached thereto. Alternately, the lifting sub 44 may be rotatably mounted to the workover beam 36 using ball bearings or the like. Extensions for the lifting sub 44 may be provided to accommodate connection to wellheads of varying height.

Figure 5:
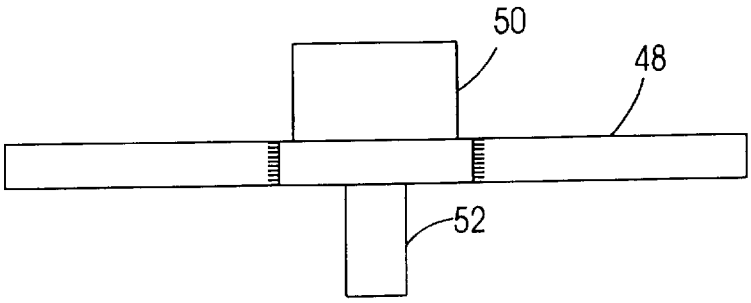
FIG. 5 is a schematic elevational view of a workover beam shown in FIG. 4, with a motor mounted thereto to facilitate rotation of a wellhead or a production tubing.

FIG. 5 illustrates a workover beam 48 which may be used in place of the workover beam 36 described above. A hydraulic motor 50 is mounted to the workover beam 48 and is operably connected to a lifting sub 52. The hydraulic motor 50 is adapted to rotate the wellhead and attached tubing string to unseat or reseat packers or anchors, etc. when the lifting sub 52 is attached to the wellhead 34.

Figure 6:
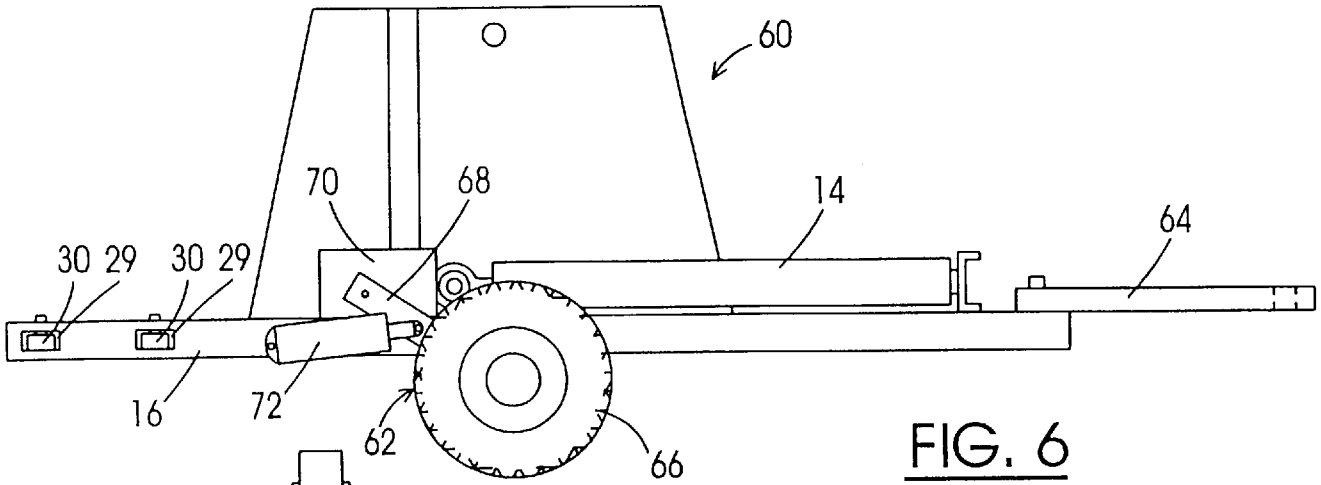
FIG. 6 is a schematic side elevational view of the apparatus shown in FIGS. 1–5 equipped with wheels and a tongue to permit the apparatus to be towed to a well site, the wheels being in a lowered position adapted for transport.
Figure 7:
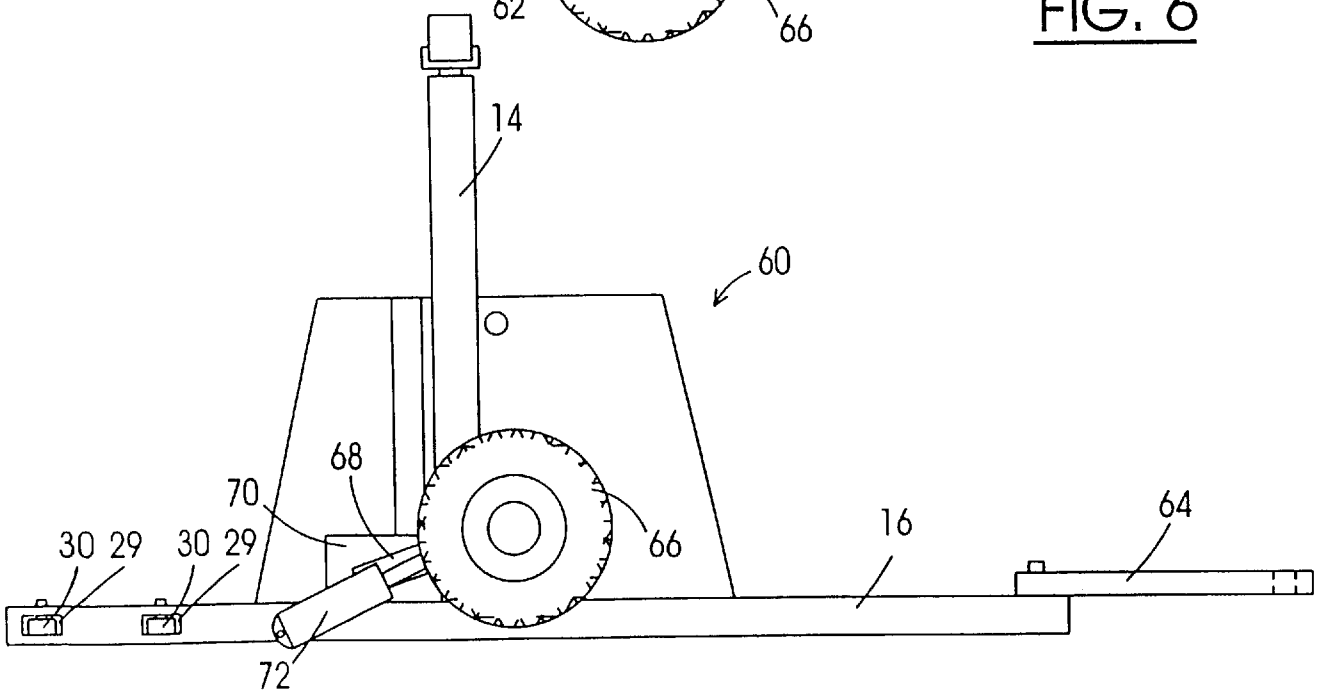
FIG. 7 is a schematic side elevational view of the apparatus shown in FIG. 6, showing the apparatus in a working position with the wheels raised.

The apparatus 10 may be constructed as a skid, as illustrated in FIG. 1, or it may be rubber wheel mounted and provided with a hitch for towing. The apparatus 10 is preferably not more than 8 feet (2.44 m) wide to enable legal highway towing and about 12 feet (3.66 m) long for extra base stability over the wellhead. The lifting devices 14 are preferably not less than 8 feet (2.44 m) long to ensure at least an 8 foot (2.44 m) stroke. The apparatus 60, illustrated in FIG. 6, has a similar configuration to the apparatus 10, except that a pair of wheel assemblies 62 are pivotally mounted to the base beams 16, and a hitch member 64 that is mounted to the endmost permanent cross-member 28. Alternatively, the hitch member 64 may be mounted to one or both of the removable cross-members 30. Each wheel assembly 62 includes a wheel 66 which is rotatably supported by a pivot member 68. The pivot member 68 is, in turn, pivotally mounted to an anchor member 70 which is welded to the outer side of the base beam 16. A double-acting hydraulic cylinder 72 is pivotally mounted to the outside of the base beam 16 and a ram of the double-acting cylinder is pivotally connected to the pivot member 68 so that the wheel assembly 66 pivots down to support the apparatus 60 when the ram of the double-acting hydraulic cylinder 72 is stroked in. The pivot member is preferably locked in the lowered position shown in FIG. 6 using a locking pin (not shown), or the like. To place the apparatus 60 in the working position shown in FIG. 7, the locking pin (not shown) is removed from the pivot member 68 and the double-acting hydraulic cylinder 72 is operated so that the ram is extended and the wheel 66 pivots up off from the ground as illustrated in FIG. 7.

Figure 8:
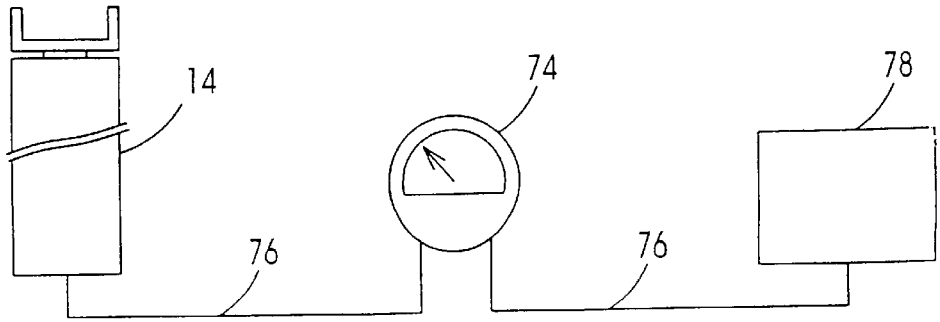
FIG. 8, which appears on sheet one of the drawings, is a schematic diagram of a hydraulic system, showing a pressure gauge which may be used for calculating the weight of a wellhead and/or a production tubing during a well servicing or a workover operation.

FIG. 8 illustrates a hydraulic system used to augment the lifting device 14 when the lifting devices 14 are hydraulic cylinders. A pressure gauge 74 is connected to a hydraulic fluid supply line 76 which is connected to a pressurized hydraulic fluid source 78 and the lifting devices 14. Readings taken from the pressure gauge 74 may be used to calculate the weight of the wellhead 34 and attached production tubing being lifted, using methods well known in the art.

In operation, the apparatus 10 is transported to a well site and is moved to a position in which the wellhead 34 is flanked by the base assemblies 12 and the two pivots 22 are aligned with the center of the wellhead 34. The lifting devices 14 are pivoted from the horizontal position to the vertical position where they are stopped by the ram supports 20. The lock pins 26 are inserted in the respective bores 24 to lock the cylinders 14 in the vertical position. The workover beam 36 is placed in the cradles 40 on the ram end of each lifting device 14, and the lock pins 42 are inserted into the corresponding bores in the workover beam 36. A lifting sub 44 and swivel 46 are assembled with a length that reaches a top of the wellhead 34. Typically, a cap 35 on the wellhead 34 is removed after appropriate valves are closed and the lifting sub 44 is threadedly attached to a top of the wellhead 34. The apparatus 10 is now ready to lift the wellhead 34. The BOP 80 is closed and the wellhead 34 is unbolted at an appropriate flange depending on a specific workover or servicing to be done.

If the BOP is to be lifted, the well is killed first by injecting an appropriate fluid to overbalance natural pressure in the well. For example, in preparation for a well stimulation operation, a blowout preventer protector (BOP) disclosed by the Applicant in the U.S. Pat. No. 5,819,851 which issued on Oct. 13, 1998 is mounted to a top of the BOP 80. Consequently, the well is killed and the wellhead is split below the tubing hanger. The wellhead 34 is lifted along with a production tubing 82 by the workover beam 36 as pressurized hydraulic fluid is injected into the lifting devices 14. As will be understood by those skilled in the art, the wellhead 34 and the production tubing 82 may have to be rotated as they are lifted in order to unseat packers and/or anchors that support the production tubing 82 downhole. After the wellhead 34 is raised to a desired height, slips (not shown) are placed around the production tubing 82 to lock the production tubing 82 to the top of the flange of the tubing head spool 37 and then pressurized hydraulic fluid is released from the lifting devices 14. The lifting sub 44 is removed from the wellhead 34 while the wellhead 34 is supported by a crane truck or the like. The wellhead 34 is then detached from the production tubing 82 and removed from the area. A BOP and a BOP protector (not shown) is placed on the top of the tubing head spool, a high pressure valve is mounted to the BOP protector and a blast joint is connected to a top of the production tubing string.

The workover beam 36 is replaced and the lifting sub 44 is connected to a top of the production tubing string 82. High pressure hydraulic fluid is injected into the lifting devices 14 so that the slips can be removed. The production tubing string is then positioned and connected to a top of the high pressure valve in a manner well known in the art. Advantageously, a high pressure gauge (not shown) is connected to a top end of the production tubing string 82 to permit downhole pressure to be monitored during the well stimulation process. Thereafter, the kill fluid is blown out of the well and a fracturing or other stimulation operation can be conducted through the high-pressure valve and the BOP protector. After the stimulation treatment is completed, the process is reversed until the wellhead is repositioned on the well and the apparatus 10 is removed from the well site.

The apparatus 10 in accordance with the invention provides many distinct advantages over the prior art. For example, it is lightweight and can be quickly manoeuvred into position to service most wells. It requires only a few minutes of setup time and can be used to perform most workover and servicing jobs as long as there is no need to remove an extensive amount of production tubing from a well. It is also quickly removed from a well site. Furthermore, it requires fewer operators than a conventional rig, so operating overhead is reduced.

Changes and modifications to the above-described embodiment will no doubt be apparent to those skilled in the art. The scope of the invention is therefore intended to be limited solely by the scope of the appended claims.

I claim:

1. An apparatus for well servicing or workover comprising:

a pair of base assemblies connected to each other in a spaced apart relationship adapted to flank a wellhead;

a pair of hydraulic cylinders respectively mounted to the base assemblies, the hydraulic cylinders including securing components at an end of rams thereof for securing a workover beam to the rams, the hydraulic cylinders being used to lift one of the wellhead, the wellhead with an attached production tubing string, and a production tubing string;

the workover beam being supported at opposite ends by the securing components on the ends of the rams of the hydraulic cylinders; and a lifting sub connected to the workover beam and adapted for detachable connection to the wellhead or the production tubing string so that the wellhead or the production tubing string is rotatable when disconnected from a well and the lifting devices are operated to raise the workover beam.

2. An apparatus as claimed in claim 1 wherein the lifting sub is rotatable relative to the workover beam so that the wellhead may be rotated while it is attached to the lifting sub.

3. An apparatus as claimed in claim 2 further comprising a motor mounted to the workover beam and associated with the lifting sub to permit the wellhead or a production tubing connected to the lifting sub to be rotated under mechanical force exerted by the motor.

4. An apparatus as claimed in claim 1 further comprising a pressure gauge connected to a hydraulic fluid line between a hydraulic fluid source and the hydraulic cylinders.

5. An apparatus as claimed in claim 1 further comprising wheel assemblies which are rotatably attached to the base assemblies to permit the apparatus to be towed.

6. An apparatus as claimed in claim 5 wherein the wheel assemblies are attached to the base assemblies by a lift mechanism so that the wheel assemblies are adapted to be rotated so that a wheel of each wheel assembly is off the ground while the apparatus is being worked.

7. The apparatus as in claim 1, wherein said base beams are interconnected by a plurality of cross members.

8. The apparatus as in claim 7, wherein said wellhead is received between said base beams in said flanking position between opposing central regions of said base beams and wherein at least one of said cross members is detachably connected to said base beams to permit the apparatus to be positioned so that the base beams flank the wellhead.

9. An apparatus for well servicing or workover comprising:

a pair of base assemblies connected to each other in a spaced apart relationship adapted to flank a wellhead;

a pair of lifting devices respectively mounted to the base assemblies for lifting one of the wellhead, the wellhead with an attached production tubing string, and a production tubing string;

a workover beam supported at opposite ends by the lifting devices; and a lifting sub connected to the workover beam and adapted for detachable connection to the wellhead or the production tubing string so that the wellhead or the production tubing string is rotatable when disconnected from a well and the lifting devices are operated to raise the workover beam, wherein each of the base assemblies comprises a base beam, a plate extending longitudinally of and upwardly from the base beam, and a locking device associated with the plate for releasably retaining the cylinder in a vertical position.

10. An apparatus as claimed in claim 9 wherein the cylinder is mounted to the plate by a pivotal member perpendicular to the plate so that the cylinder is pivotally moveable to a horizontal position for transportation, in which position the cylinder is parallel to the base beam.

11. An apparatus as claimed in claim 10 wherein the base beams are parallel to each other and interconnected by a plurality of cross members.

12. An apparatus as claimed in claim 11 wherein the cross members are permanently affixed to one end of the base beams and detachably connected to the other end of the base beams to permit the apparatus to be positioned so that the base beams flank the wellhead.

13. An apparatus as claimed in claim 9 wherein the locking device comprises a ram support protruding from the plate and a locking pin detachably received in a bore in the plate so that the lifting device is selectively held in the vertical position between the ram support and the locking pin.

14. A method of well servicing or workover comprises:

a) placing on a well site an apparatus which includes a pair of interconnected base assemblies adapted to flank a wellhead, a pair of lifting devices mounted to the base assemblies, a workover beam supported at each end by the respective lifting devices, and a lifting sub connected to the workover beam and adapted for detachable connection to one of the wellhead and production tubing so that the wellhead is flanked by the base assemblies;

b) connecting the wellhead to the lifting sub;

c) disconnecting the wellhead at a point required by the well servicing or workover operations;

d) raising the workover beam by operating the lifting devices;

e) performing the well servicing or workover operations;

f) lowering the workover beam by operating the lifting devices after the well servicing or workover operation is completed;

g) reconnecting the wellhead and disconnecting the lifting sub from the wellhead; and h) removing the apparatus from the well site.

15. A method as claimed in claim 14 wherein step b) is completed by:

removing a wellhead cap and connecting the lifting sub to a top of the wellhead.

16. A method of lifting a wellhead for well workover or servicing, comprising steps of:

a) placing an apparatus which comprises a pair of interconnected base assemblies adapted to flank a wellhead, a pair of hydraulic cylinders pivotally mounted to the base assemblies and securely supported in a vertical position, a workover beam supported at each end by the respective lifting devices, and a lifting sub connected to the workover beam and adapted for detachable connection to one of the wellhead and production tubing so that the wellhead is flanked by the base assemblies;

b) closing a blowout preventer which is mounted to a top of a tubing head spool;

c) removing a wellhead cap and connecting the lifting sub to one of an aperture in a top of the wellhead and the production tubing;

d) unbolting the wellhead from the blowout preventer;

e) raising the workover beam by injecting pressurized hydraulic fluid into the hydraulic cylinders to lift the wellhead;

f) removing the wellhead and performing the well workover or servicing;

g) replacing the wellhead on the blowout preventer;

h) disconnecting the lifting sub from the one of the wellhead and the production tubing and placing the wellhead cap back on the wellhead; and i) removing the apparatus from the well site.

* * * * *